US005397089A

United States Patent [19]

Kataoka

[11] Patent Number: 5,397,089

[45] Date of Patent: Mar. 14, 1995

[54] GLASS HOLDER

[75] Inventor: Joji Kataoka, Tokyo, Japan

[73] Assignee: Kataoka Bussan Kabushiki Kaisha, Tokyo, Japan

[21] Appl. No.: 168,323

[22] Filed: Dec. 17, 1993

[30] Foreign Application Priority Data

Apr. 22, 1993 [JP] Japan ..... 5-131514

[51] Int. Cl.[6] ..... A47J 45/00

[52] U.S. Cl. ..... 248/311.2; 248/231.8; 248/314; 248/312; 220/737; 220/23.83

[58] Field of Search ..... 248/311.2, 231.8, 225.31, 248/346.1, 314, 312; 220/23.83, 737; 297/188

[56] References Cited

U.S. PATENT DOCUMENTS

| | | | |
|---|---|---|---|
| 556,200 | 3/1896 | McDonald | 220/737 X |
| 1,151,923 | 8/1915 | Blackwell | 220/737 X |
| 2,431,752 | 12/1947 | Hilstrom | 248/231.8 X |
| 2,795,121 | 6/1957 | Pantello | 220/737 X |
| 2,916,180 | 12/1959 | Alger | 220/737 X |
| 3,575,315 | 4/1971 | Rosen | 220/23.83 |
| 4,607,758 | 8/1986 | Stevens | 220/23.83 |
| 4,785,959 | 11/1988 | Kleiner | 220/737 X |
| 4,799,638 | 1/1989 | Allen | 297/188 X |
| 4,961,555 | 10/1990 | Egan, Jr. | 248/231.8 |

FOREIGN PATENT DOCUMENTS

| | | |
|---|---|---|
| 62-42473 | 7/1987 | Japan . |
| 63-138182 | 11/1988 | Japan . |
| 1-119570 | 2/1989 | Japan . |
| 1-179572 | 3/1989 | Japan . |

*Primary Examiner*—Karen J. Chotkowski

*Attorney, Agent, or Firm*—Lowe, Price, LeBlanc & Becker

[57] ABSTRACT

A glass holder is provided which is used to hold a glass stably at the edge of a dish. It has a glass holding body shaped like a cup and a cylindrical mounting frame vertically extending from the underside of the bottom of the glass holding body. The mounting frame is cut horizontally halfway around to form a mounting section so that the edge of a dish can freely be inserted into or removed from the mounting section.

7 Claims, 5 Drawing Sheets

GLASS HOLDER

BACKGROUND OF THE INVENTION

1. Field of the Invention

The present invention relates to a glass holder that allows a glass to be removably placed at the edge of a dish.

2. Description of the Relevant Art

At parties, when eating while standing, one often has to hold a glass of drink and a hand-held dish at the same time. When a person picks up food and put it on his dish or when he eats the food, the glass should be put temporarily on a table or the like to free his hand. He also has to find an appropriate location on which to place his glass and to take care so that his glass will not be taken for other glasses placed near by. Because of such additional attention he may not be able to enjoy the party. At times the person may be forced to hold both glass and dish while eating and accidentally make a mess.

To cope with such a problem, a glass holder has been proposed, which enables a person to hold with one hand both dish and glass with the glass held at the edge of the dish. Exemplary patent applications that propose such a glass holder include Japanese Utility Model Preliminary Publication No. Showa 62-42473, Showa 63-138182, Heisei 1-119570, and Heisei 1-179572.

These glass holders have as basic constituent elements a holding section that holds a glass upright and a clamping section that clamps the edge of the dish to fix the holding section to the dish. In the Japanese Utility Model Preliminary Publication No. Showa 63-138182, when attached to a dish, the glass holder has its holding section located on the edge of the dish to support a glass. In other glass holders, the clamping section grips the edge of the dish with the holding section projecting out from the dish.

SUMMARY OF THE INVENTION

Of the above-mentioned proposed glass holders, the former type holds a glass on the edge of the dish so that the glass is stable. But the glass holder of this type cannot be used to hold legged glasses. Since the holding section is formed by simply erecting four tongue pieces, the glass holders also cannot be readily stacked one upon the other for easy storage. As for the latter three examples, on the other hand, since the holding section protrudes outside the edge of the dish, the glass holder can hold even legged glasses. However, because the glass is supported outside the dish, the clamping section is required to have a strong gripping force, which makes troublesome the procedure for attaching the clamping section to the dish.

In light of the above-mentioned drawbacks of the conventional glass holders, the present invention has been accomplished to offer improvements in these points. The primary objective of this invention is to provide a glass holder which has an improved dish-edge-attaching performance with easy operation and which, when holding a glass, supports it with improved stability by holding the dish and the glass firmly together.

Another objective of this invention is to provide a glass holder which can be stacked one upon the other for compact storage and easy handling and transport.

A further objective of this invention is to provide a glass holder which can hold not only ordinary glasses but also legged glasses in a stable condition.

To achieve the above objective, according to an aspect of this invention, there is provided a glass holder which comprises: a glass holding body comprising a bottom and a circumferential wall connected vertically relative thereto to allow a glass bottom portion to be freely inserted into or removed from the glass holding body; a mounting frame extending vertically from the bottom of the glass holding body, the mounting frame having a horizontal inwardly curved arcuate wall surface; and a mounting section comprising a horizontal strip of cut formed in the mounting frame so that the edge of a dish can be freely inserted into the mounting section. The glass holder of this construction can be easily and stably attached to the dish.

According to another aspect of this invention, there is provided a glass holder which includes: a glass holding body comprising a bottom and a circumferential wall connected vertically thereto; a mounting frame vertically extending from an underside of the bottom of the glass holding body, the mounting frame having a horizontal inwardly curved arcuate wall surface; a mounting section comprising a horizontal strip of cut formed in the arcuate wall surface so that from outside the mounting frame an edge of a dish can be freely inserted into or removed from the strip of cut vertical openings formed in alignment in the circumferential wall of the glass holding body and in the mounting frame at positions opposite the side where the mounting section is provided; and a glass leg holding section comprising a cut formed in the bottom of the glass holding body, the cut extending from the edge toward the center of the bottom of the glass holding body so that the cut is continuous to the vertical openings.

The preferred embodiment of the present invention will now be described in detail in conjunction with the accompanying drawings. These and other objects and features of this invention will become apparent from the following description.

DETAILED DESCRIPTION OF PREFERRED EMBODIMENT

Figure 1:
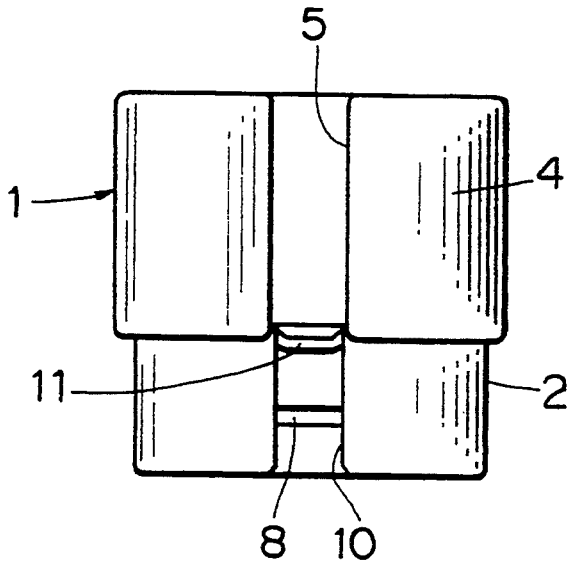
FIG. 1 is a front view of a glass holder according to this invention.
Figure 2:
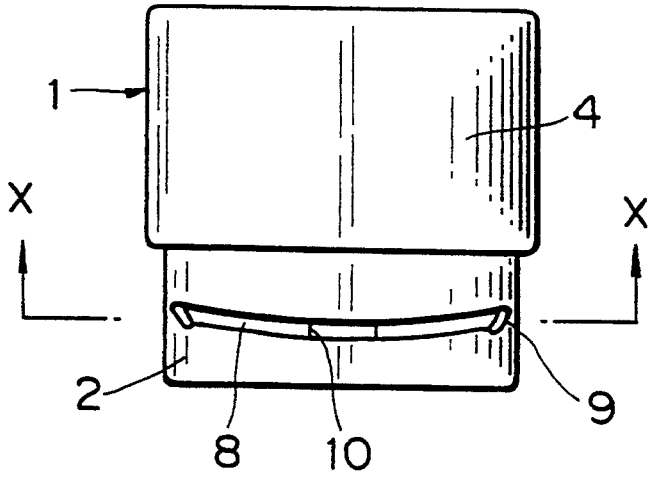
FIG. 2 is a rear view of the glass holder.
Figure 3:
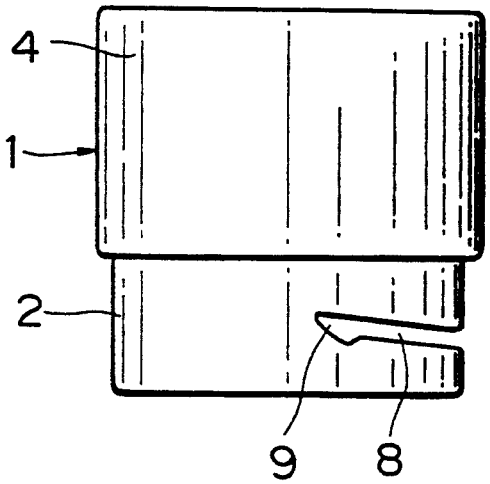
FIG. 3 is a right-hand side view of the glass holder.
Figure 4:
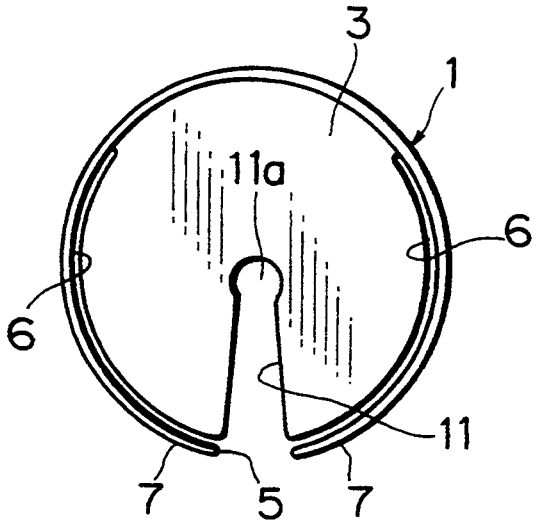
FIG. 4 is a plan view of the glass holder.
Figure 5:
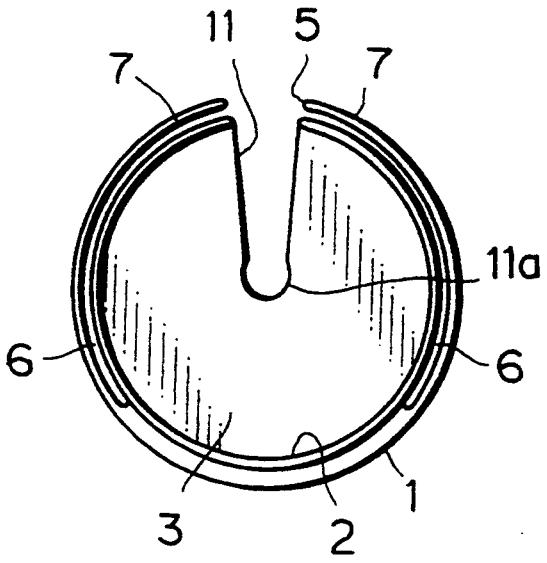
FIG. 5 is a bottom view of the glass holder.
Figure 6:
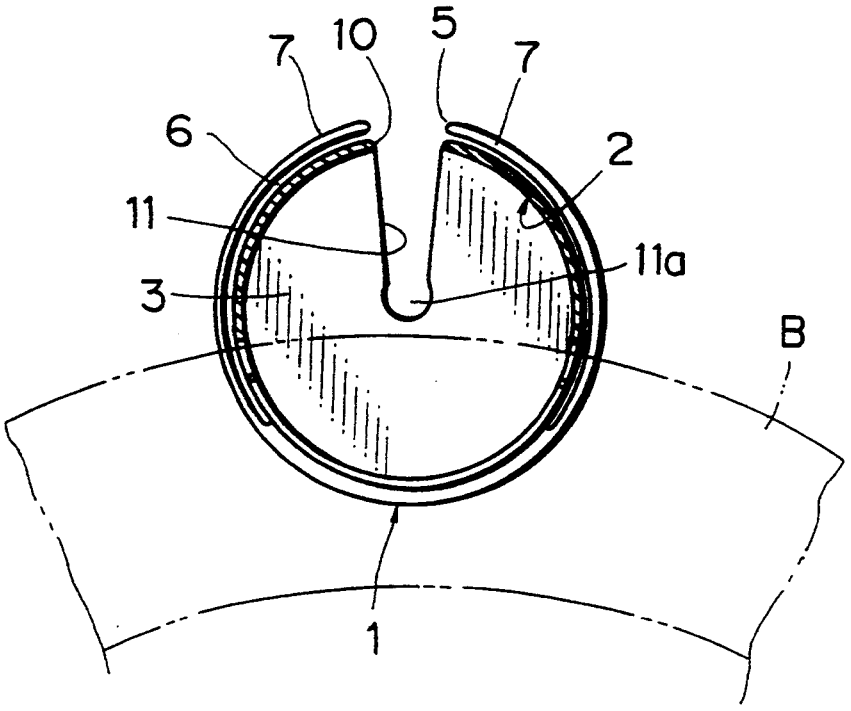
FIG. 6 is a bottom cross sectional view taken along the line X—X of FIG. 2.
Figure 7:
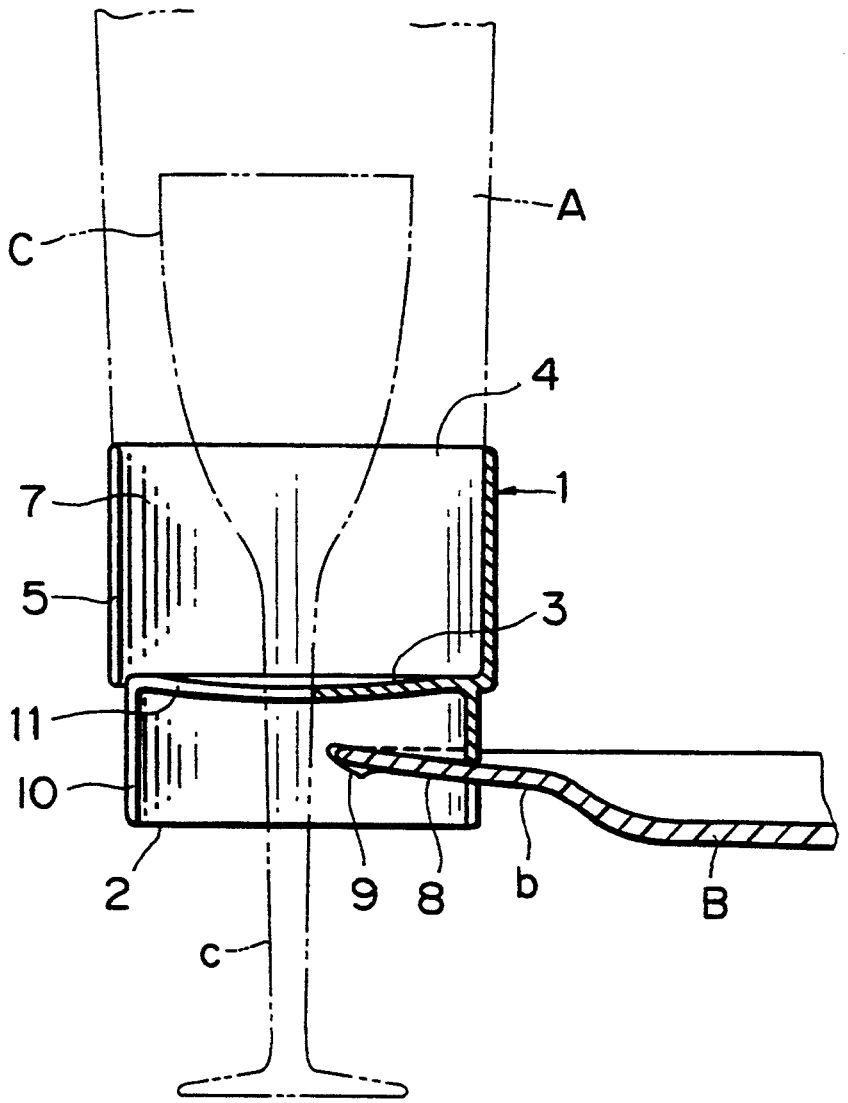
FIG. 7 is a central vertical cross section of the glass holder attached to a dish, viewed from the right side.

FIG. 1 shows a preferred embodiment of the glass holder according to the present invention. FIG. 1 is a front view of the glass holder, FIG. 2 a rear view, FIG. 3 a right-hand side view, FIG. 4 a plan view, FIG. 5 a bottom view, and FIG. 6 a cross-sectional bottom view taken along the line X—X of FIG. 2. In these figures, designated 1 is a glass holding body of the glass holder shaped like a cup. A mounting frame 2 that attaches to a dish extends vertically downwardly from the bottom 3 of the glass holding body.

The glass holding body 1 has a cylindrical, circumferential wall 4 of a specified height to accept the bottom part of a glass A. The glass holding body 1 has a vertical slit to form an opening 5. The bottom portion of the circumferential wall 4 facing the opening 5 is formed with a cut 6 (FIG. 4) along the circumferential direction to separate a part of the circumferential wall 4 and thereby form spring portions 7, 7.

The mounting frame 2 is formed cylindrical and has a size such that it is installed in the circumferential wall 4 of the glass holding body 1. The mounting frame 2 has a horizontal strip of cut formed in its circumferential wall to form a mounting section 8. Although it is formed to be cylindrical, the mounting frame 2 need only be a frame having an arcuate wall surface with a mounting section 8 cutting horizontally into its wall surface.

The mounting section 8 accepts the edge b of a pick-up dish B. The cut in the mounting section 8 is set slightly smaller in thickness than the edge of a commonly used pick-up dish.

In this embodiment, the mounting section 8 is provided on the rear side of the glass holding body 1 opposite the opening 5. The mounting section 8 is located at nearly the central portion of the mounting frame 2 in terms of height and laterally extends halfway round the frame.

To snugly accept the edge b of the dish B which is slightly curved upward, the mounting section 8 is slanted upward moderately from the central portion toward the ends so that the glass holder remains horizontal when mounted. The mounting section 8 has an expanded portion 9 at each end to allow the mounting section to easily expand as the dish is forced into it.

On the front side, the mounting frame 2 has an opening 10 formed vertically aligned with the opening 5 in the glass holding body 1. The bottom 3 of the glass holding body 1 is cut with a glass leg holding section 11 for accepting the leg c of a legged glass C, which extends from the edge of the bottom toward the center at a position such that the leg holding section 11 is continuous to the openings 5 and 10.

The openings 5 and 10 are formed to accept the leg of the glass into the leg holding section 11. Hence, these openings have the widths to allow the leg c of the glass to pass therethrough, and the leg holding section 11 also has a similar width.

The leg holding section 11 is progressively narrowed in width from the edge of the bottom of the glass holding body toward the center, with the central end formed as a circular expanded portion 11*a*. When the glass leg is introduced into the central expanded portion of the leg holding section and the glass C is lowered, the upper large-diameter section of the glass leg fits into it, preventing the glass leg from shifting toward the opening.

The glass holder of this invention has the above-mentioned construction and is preferably made of plastic and molded as one integral piece. In use, the side surface of the mounting frame 2 is put in contact with the edge b of the dish B so that the mounting section 8 faces the dish edge, and then the glass holder is pushed against the dish to accommodate the dish edge into the mounting section.

Since the mounting section 8 extends horizontally halfway round the cylindrical mounting frame 2, when the edge b of the dish B is inserted into it, the upper edge and the lower edge of the cut portion or mounting section engage the upper surface and the lower surface of the dish edge b, respectively. The mounting section 8 thus stably clamps the dish edge, firmly fixing the glass holder to the dish. Resiliency of the material of the glass holder allows the mounting section to be expanded slightly. Because the mounting section is formed slightly narrower than the thickness of the dish edge b, the mounting section elastically but firmly grips the dish edge.

The mounting section 8 cuts horizontally across a part of the cylindrical mounting frame 2 to partly separate the lower part of the mounting frame, whose central portion can be deflected about the base portions at the ends of the mounting section 8 thanks to the resiliency of the material. The base portion, which forms the connecting portion between the body of the mounting frame 2 and the partly separated lower portion, can be provided with a desired cross-sectional area by changing the vertical position of the mounting section. In other words, it is possible to produce a desired clamping force to enable firm mounting of the glass holder.

With the glass holder mounted to the dish in this way, a glass A is put into the glass holding body 1 from above.

To hold the glass A stably, the glass holding body 1 is formed such that its inner diameter is equal to the outer diameter of the bottom portion of the glass A. To absorb manufacturing errors and to increase the kinds of glasses usable, the circumferential wall 4 of the glass holding body 1 is formed to be expandable as mentioned hereinabove. Therefore, as the bottom of the glass is pushed down against the bottom of the glass holding body, the glass A is gripped at its cylindrical body portion by the spring portions 7, 7 and held in a stable condition. The glass A can of course be taken out of the glass holder freely.

As described earlier, the glass holder mounted to the dish B can hold a legged glass C.

With the legged glass C supported by the glass holder, the leg c of the glass C vertically extends downwardly from the bottom 3 of the glass holding body 1, as shown. To avoid contact between the leg c and the edge b of the dish B, this embodiment has the mounting section 8 cut to a depth that does not reach the center position of the bottom 3 and the leg holding section 11 cut to a depth that does not reach the edge of the dish fitted into the mounting section 8. When the depth of the leg holding section 11 is set shallow so that it does not reach the center of the bottom, the mounting section 8 can be cut deeper accordingly.

The leg holding section 11 has an expanded portion 11*a* to stabilize the holding position of the glass C. When the glass with its leg c fitted in the intermediate portion of the leg holding section 11 is lowered, the body of the glass comes inside the glass holding body 1, so that even if the leg should be moved laterally toward the opening 5, the glass is prevented from slipping out of the glass holder.

Figure 8:
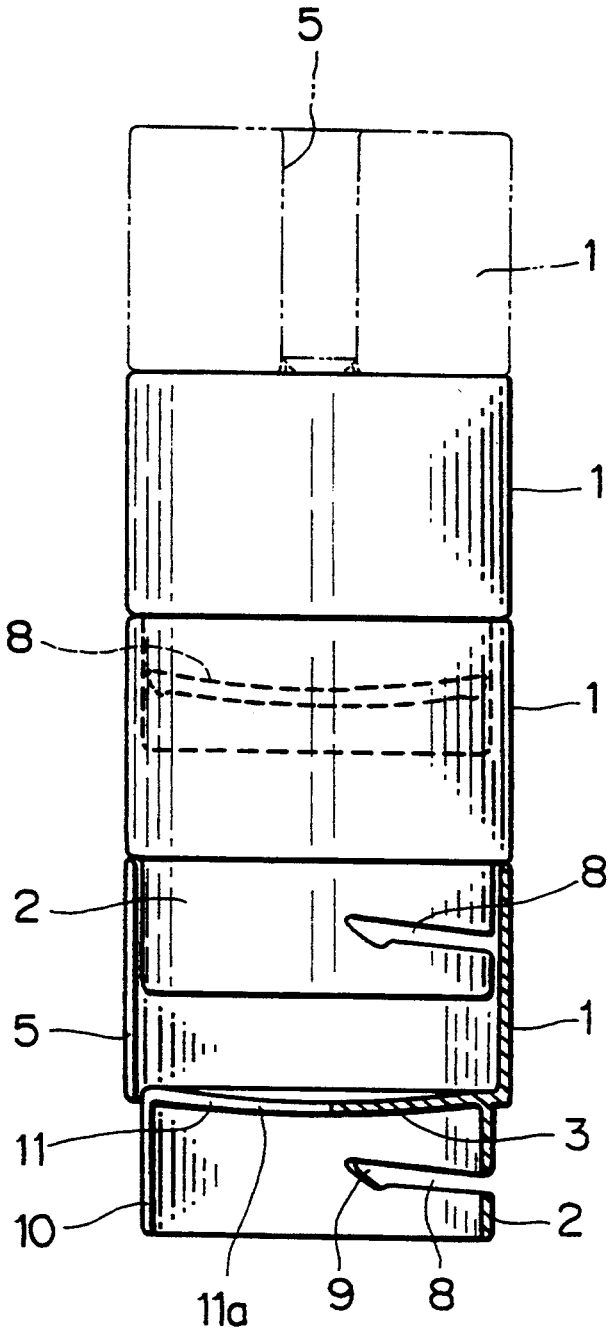
FIG. 8 is a partially cross-sectioned, right-side view of glass holders stacked.

FIG. 8 is a side view, partly cross-sectioned, of the glass holders stacked one upon the other, in which condition they can be stored or transported. Each glass holder is stacked with its mounting frame 2 fitted into the holding body of another glass holder's glass holding body.

As described above by referring to the embodiment shown in the figures, this invention has various advantageous features. Since the mounting section is formed by cutting halfway around the circumferential surface of the mounting frame, the glass holder can easily be attached to the edge of a dish by simply pressing-the dish edge against the circumferential surface to fit the dish edge into the mounting section. The attaching of the glass holder can easily be done by one hand with the other hand holding the dish.

Because the mounting section is formed by cutting halfway around the circumferential surface of the mounting frame, a clamping force obtained thereby is strong enough to stably and firmly support a glass.

When the glass holder of this invention is attached to a dish, nearly half of the glass holder is placed on the upper surface of the dish edge so that the weight of the glass can be supported on the dish and easily balanced by a hand holding the dish. At the same time because the dimension by which the glass holder protrudes outside the dish is small, the glass holder is effectively prevented from abutting against other objects while being carried.

The circumferential wall of the glass holding body is formed with a spring portion so that the glass holding body is resilient and expandable. This allows glasses of different outer diameters to be held. The glass is always firmly gripped by the circumferential wall.

Another advantage is that the glass holder of this invention can stably hold legged glasses in addition to ordinary glasses. When not in use, the glass holders can be stacked with the glass holding body of one holder fitted into other holder's glass holding body for easy storage and transport.

Since the glass holder is made of a plastic material as a one-piece integral product, it can be mass-produced at low cost.

What is claimed is:

1. A glass holder, comprising:

a glass holding body comprising a bottom and a circumferential wall connected vertically relative thereto;

a mounting frame extending vertically from an underside of the bottom of the glass holding body, the mounting frame having a horizontal inwardly curved arcuate wall surface; and a mounting section comprising a horizontal strip of cut formed in the arcuate wall surface so that from outside the mounting frame an edge of a dish can be freely inserted into or removed from the strip of cut.

2. A glass holder according to claim 1, wherein: the mounting frame is cylindrical.

3. A glass holder according to claim 1, wherein: the horizontal strip of cut of the mounting section is located in the arcuate wall surface and is progressively inclined upward from a center.

4. A glass holder according to claim 1, wherein: the glass holding body has a vertical opening at a part of the circumferential wall thereof, and the glass holding body also has an expandable spring which is formed by making a cut in a lower part of the circumferential wall running in a circumferential direction from the opening.

5. A glass holder according to claim 2, wherein: a portion of the cylindrical mounting frame, vertically extending from the underside of the bottom of the glass holding body, is so sized that it can be fitted inside a similar glass holding body.

6. A glass holder, comprising:

a glass holding body comprising a bottom and a circumferential wall connected vertically thereto;

a mounting frame vertically extending from an underside of the bottom of the glass holding body, the mounting frame having a horizontal inwardly curved arcuate wall surface;

a mounting section comprising a horizontal strip of cut formed in the arcuate wall surface so that from outside the mounting frame an edge of a dish can freely be inserted into or removed from the strip of cut, with vertical openings formed in alignment in the circumferential wall of the glass holding body and in the mounting frame at positions opposite a side where the mounting section is provided; and a glass leg holding section comprising a cut formed in in the bottom of the glass holding body, the cut extending from an edge toward a center of the bottom of the glass holding body so that the cut is continuous to the vertical openings.

7. A glass holder according to claim 6, wherein: the glass leg holding section in the bottom of the glass holding body is formed to such a depth that it does not contact the edge of a dish fitted into the mounting section formed in the mounting frame.

* * * * *